US005498810A

United States Patent [19]

Bogdan et al.

[11] Patent Number: 5,498,810

[45] Date of Patent: Mar. 12, 1996

[54] SELECTIVE ISOPARAFFIN SYNTHESIS FROM NAPHTHA

[75] Inventors: Paula L. Bogdan, Mount Prospect; R. Joe Lawson, Arlington Heights; J. W. Adriaan Sachtler, Des Plaines; Robert J. Schmidt, Barrington, all of Ill.

[73] Assignee: UOP, Des Plaines, Ill.

[21] Appl. No.: 293,530

[22] Filed: Aug. 19, 1994

Related U.S. Application Data

[63] Continuation-in-part of Ser. No. 77,587, Jun. 18, 1993, abandoned, which is a continuation-in-part of Ser. No. 796,562, Nov. 21, 1991, Pat. No. 5,235,120.

[51] Int. Cl.$^6$ ..... C07C 6/00

[52] U.S. Cl. ..... 585/310; 585/737; 585/752; 585/940

[58] Field of Search ..... 585/310, 737, 585/940; 208/752, 60

[56] References Cited

U.S. PATENT DOCUMENTS

| | | | |
|---|---|---|---|
| 3,692,666 | 9/1972 | Pollitzer | 208/112 |
| 3,759,819 | 9/1973 | Attane et al. | 208/57 |
| 3,788,975 | 1/1974 | Donaldson | 208/60 |
| 3,933,619 | 1/1976 | Kozlowski | 208/60 |
| 4,647,368 | 3/1987 | McGuiness et al. | 208/60 |
| 5,003,118 | 3/1991 | Low et al. | 585/253 |

*Primary Examiner*—Asok Pal

*Attorney, Agent, or Firm*—Thomas K. McBride; John F. Spears, Jr.; Richard E. Conser

[57] ABSTRACT

A process combination is disclosed to selectively upgrade naphtha to obtain products suitable for further upgrading to reformulated fuels. A naphtha feedstock is hydrogenated to saturate aromatics, followed by selective isoparaffin synthesis to yield light and heavy naphtha and isobutane; isobutane and isopentane in the product are obtained in superequilibrium concentrations. The heavy naphtha may be processed by reforming, light naphtha may be isomerized, and isobutane may be upgraded by dehydrogenation, etherification and/or alkylation to yield gasoline components from the process combination suitable for production of reformulated gasoline.

15 Claims, 2 Drawing Sheets

SELECTIVE ISOPARAFFIN SYNTHESIS FROM NAPHTHA

CROSS REFERENCE TO RELATED APPLICATION

This application is a continuation-in-part of prior application Ser. No. 08/077,587, filed Jun. 18, 1993, now abandoned, which is a continuation-in-part of Ser. No. 07/796,562, filed Nov. 21, 1991, now U.S. Pat. No. 5,235,120, the contents of both of which are incorporated herein by reference thereto.

BACKGROUND Of THE INVENTION

1. Field of the Invention

This invention relates to an improved process combination for the conversion of hydrocarbons, and more specifically for the selective upgrading of naphtha fractions by a combination of aromatics removal and selective isoparaffin synthesis.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins. Current gasolines generally have aromatics contents of about 30% or higher, and may contain more than 40% aromatics.

Currently, refiners are faced with the prospect of supplying reformulated gasoline to meet tightened automotive emission standards. Reformulated gasoline would differ from the existing product in having a lower vapor pressure, lower final boiling point, increased content of oxygenates, and lower content of olefins, benzene and aromatics. The oxygen content of gasoline will be 2 mass % or more in many areas. Gasoline aromatics content is likely to be lowered into the 20–25% range in major urban areas, and low-emission gasoline containing less than 15 volume % aromatics is being advocated for some areas with severe pollution problems. Distillation end points also could be lowered, further restricting aromatics content since the high-boiling portion of the gasoline which thereby would be eliminated usually is an aromatics concentrate. End point often is characterized as the 90% distillation temperature, currently limited to a maximum of 190° C. and averaging 165°–170° C., which could be reduced to around 150° C. in some cases.

Since aromatics have been the principal source of increased gasoline octanes during the recent lead-reduction program, severe restriction of the aromatics content and high-boiling portion will present refiners with processing problems. Currently applicable technology includes such processes as recycle isomerization of light naphtha and generation of additional light olefins through fluid catalytic cracking and isobutane through isomerization as feedstock to an alkylation unit. Increased blending of oxygenates such as methyl tertiary-butyl ether (MTBE) and ethanol will be an essential part of the reformulated-gasoline program, but feedstock supplies will become stretched. Selective isoparaffin synthesis to produce desirable gasoline components is known but has not yet become attractive for commercialization.

A process designated as "I-cracking" for increasing the yield of naphtha and isobutane is disclosed in U.S. Pat. No. 3,692,666 (Pollitzer). U.S. Pat. No. 3,788,975 (Donaldson) teaches a combination process for the production and utilization of aromatics and isobutane. The combination includes selective production of isobutane from naphtha followed by a combination of processes including catalytic reforming, aromatic separation, alkylation, isomerization, and dehydrogenation to yield alkylation feedstock. The paraffinic stream from aromatic extraction is returned to the I-cracking step. Neither Pollitzer nor Donaldson disclose the present process combination, however, nor do they recognize any problem from processing aromatics-containing charge stocks.

A combination process for gasoline production is disclosed in U.S. Pat. No. 3,933,619 (Kozlowski). High-octane, low-lead or unleaded gasoline is produced by hydrocracking a hydrocarbon feedstock to obtain butane, pentane-hexane, and $C_7$+ hydrocarbons, and the $C_7$+ fraction may be sent to a reformer. U.S. Pat. No. 4,647,368 (McGuiness et al.) discloses a method for upgrading naphtha by hydrotreating, hydrocracking over zeolite beta, recovering isobutane, $C_5$–$C_7$ isoparaffins and a higher boiling stream, and reforming the latter stream. These references do not teach or suggest the present process combination, however.

Isomerization of $C_4$–$C_6$ paraffins with a hydrogenation zone upstream to saturate benzene is taught in U.S. Pat. Nos. 3,759,819 (Attane et al.) and 5,003,118 (Low et al.). However, neither Attane et al. nor Low et al. teach selective isoparaffin synthesis yielding superequilibrium isoparaffins in excess of the concentration that would be achieved by isomerization or suggest that aromatics saturation may be applied in that context.

The prior art, therefore, contains elements of the present invention. There is no suggestion to combine the elements, however, nor of the surprising benefits in selectivity that accrue from the present process combination to obtain intermediate hydrocarbons suitable for producing reformulated gasoline.

SUMMARY OF THE INVENTION

It is an object of the present invention to provide an improved process combination to upgrade naphtha to gasoline. A specific object is to improve selectivity in producing hydrocarbons suitable for producing reformulated gasoline.

This invention is based on the discovery that a process combination comprising aromatics hydrogenation followed by selective isoparaffin synthesis provides a more even temperature profile during the synthesis step along with surprising improvements in the isoparaffin content of the synthesis product.

A broad embodiment of the present invention is directed to a process combination comprising hydrogenation of aromatics in a naphtha feedstock followed by selective isoparaffin synthesis from the hydrogenated naphtha to yield a synthesis product comprising isobutane and synthesis naphtha with reduced end point. Preferably, the hydrogenation and selective isoparaffin synthesis are accomplished in the same hydrogen circuit and the heat of hydrogenation raises the temperature of the saturated intermediate to that required for the selective isoparaffin synthesis. Optionally, heavy synthesis naphtha is separated from the products and reformed and light naphtha and isobutane are upgraded to useful gasoline blending components.

These as well as other objects and embodiments will become apparent from the detailed description of the invention.

DESCRIPTION OF THE PREFERRED EMBODIMENTS

Figure 1:
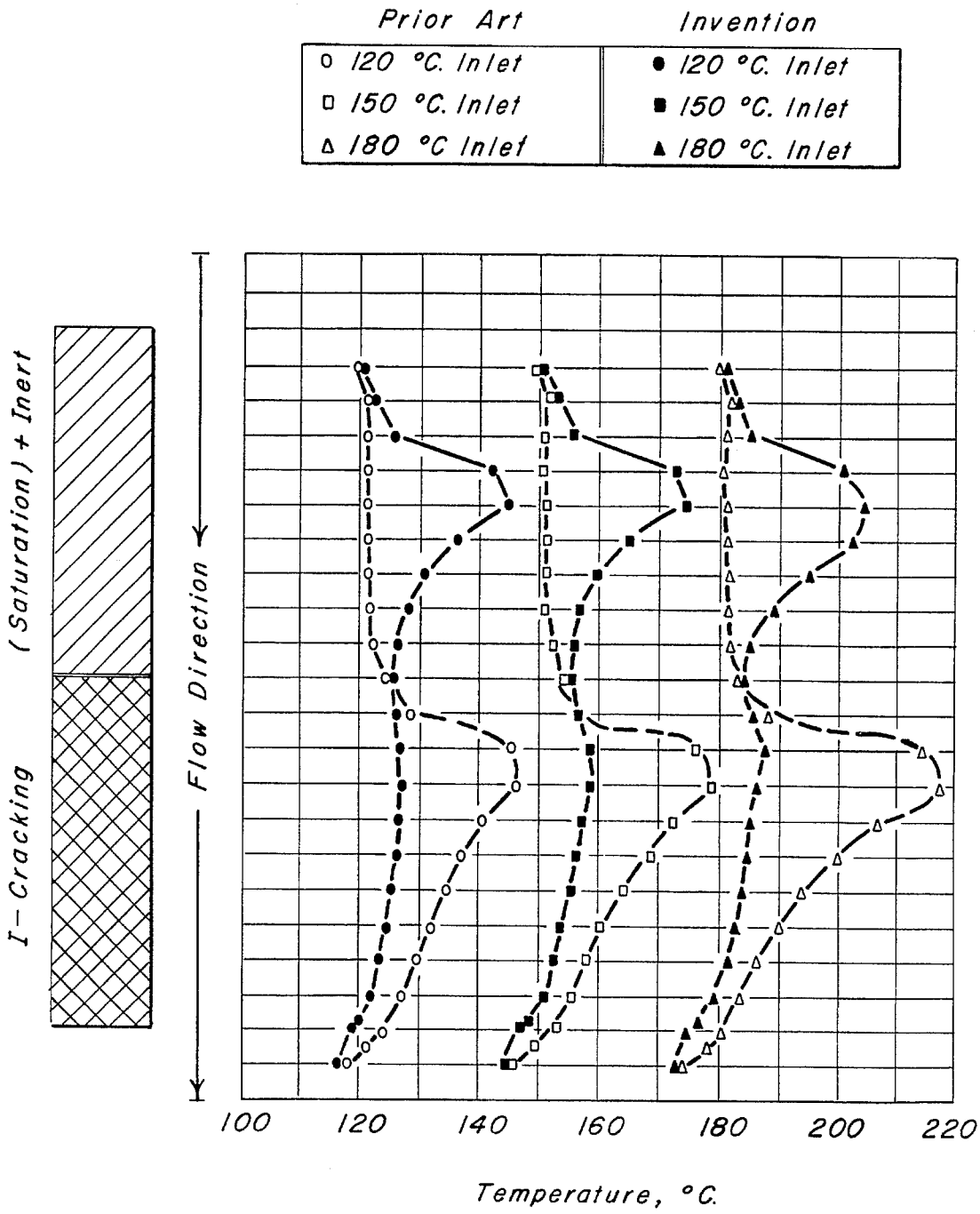
FIG. 1 shows reactor temperature profiles when using the process combination of the invention in comparison to those of the prior art.

To reiterate, a broad embodiment of the present invention is directed to a process combination comprising hydrogenation of aromatics in a naphtha feedstock followed by selective isoparaffin synthesis from the hydrogenated naphtha to yield a product comprising isobutane and synthesis naphtha with reduced end point. Usually the process combination is integrated into a petroleum refinery comprising crude-oil distillation, reforming, cracking and other processes known in the art to produce finished gasoline and other petroleum products.

The naphtha feedstock to the present process combination comprises paraffins, naphthenes, and aromatics, and may comprise small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point according to the ASTM D-86 test typically from 0° to 100° C. and a final boiling point of from about 160° to 230° C.; more usually, the initial boiling range is from about 40° to 80° C. and the final boiling point from about 175° to 200° C. with the optimal feedstock distilling within the range of 80° to 200° C. Since the objectives of end-point reduction and isoparaffin yield are more effectively accomplished by processing higher-boiling hydrocarbons, the naphtha feedstock generally contains less than about 30 mass % $C_6$ and lighter hydrocarbons, and usually less than about 20 mass % $C_6$– and less than 10 mass % pentanes and lighter. Since hexanes have boiling points of 50°–69° C. compared to the 80° to 200° C. outer limits of the optimal naphtha, hexanes preferably are substantially absent from the feedstock except for only a minor amount resulting from fractionation imprecision; hexanes and lighter paraffins thus optimally comprise less than about 5 mass % of the feedstock.

The naphtha feedstock generally contains small amounts of sulfur compounds amounting to less than 10 mass parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Organic Chemistry,* John Wiley & Sons (Fifth Edition, 1988)]. Preferably, the pretreating step will provide the selective-isoparaffin-synthesis step with a hydrocarbon feedstock having low sulfur levels disclosed in the prior art as desirable, e.g., 1 mass ppm to 0.1 ppm (100 ppb). It is within the ambit of the present invention that this optional pretreating step be included in the present process combination.

In any event the naphtha feedstock contains a substantial concentration of aromatic hydrocarbons, generally ranging from 5 to 40 liquid volume percent. These aromatics may comprise benzene, toluene and higher alkylaromatics within the boiling ranges described above, and may also comprise small amounts of naphthalenes and biphenyls within these ranges. The aromatics generally are not hydrogenated to naphthenes to a large extent in a naphtha pretreating process as described above, and thus mostly remain in the feed to a selective isoparaffin-synthesis process of the prior art. Since aromatics are essentially quantitatively hydrogenated in a selective isoparaffin-synthesis unit, the resulting exothermic heat of reaction affects the temperature profile of the selective isoparaffin-synthesis reaction to a significant extent.

The present process combination comprises a hydrogenation zone for saturating aromatic hydrocarbons and a selective-isoparaffin-synthesis zone. The naphtha feedstock is charged, along with hydrogen, to the hydrogenation zone which effects saturation of aromatics at hydrogenation conditions over a hydrogenation catalyst to produce a saturated intermediate. This intermediate is transferred to a selective-isoparaffin-synthesis zone which preferably is contained within the same hydrogen circuit, i.e., hydrogen and light hydrocarbons are not separated from the saturated intermediate before the selective-isoparaffin-synthesis zone. This single circuit obviates the need for two sets of heat exchangers, separators and compressors for hydrogen-rich gas. The saturated intermediate thus also may be transferred to the selective-isoparaffin-synthesis zone at an increased temperature resulting from the exothermic heat of the aromatics-hydrogenation reaction. In this manner, heating of the saturated intermediate optimally is not required. In the selective-isoparaffin-synthesis zone, the saturated intermediate is converted to yield lighter products at selective-isoparaffin-synthesis conditions over a selective isoparaffin-synthesis catalyst.

Naphtha feedstock and hydrogen comprise combined feed to the hydrogenation zone. The hydrogenation zone is designed to saturate aromatics at relatively mild conditions. The hydrogenation zone contains a bed of catalyst which usually comprises one or more of nickel and the platinum-group metals, selected from the group consisting of platinum, palladium, ruthenium, rhodium, osmium, and iridium, on a suitable refractory inorganic-oxide support. The inorganic-oxide support preferably comprises alumina, optimally an anhydrous gamma-alumina with a high degree of purity. The catalyst advantageously also comprises one or more modifier metals of Groups VIB (6), VIII (8–10) and IVA (14). Especially preferred catalyst compositions comprise platinum on an alumina support, treated with HCI and hydrogen. Alternatively, spent selective isoparaffin-synthesis catalyst may be used for hydrogenation after deactivation renders it unsuitable for the synthesis operation.

Such catalysts have been found to provide satisfactory aromatics saturation at conditions including pressures from about 10 to 100 atmospheres gauge, preferably between about 20 and 70 atmospheres, and temperatures of 30° to 120° C. Hydrogen to hydrocarbon ratios are in the range of about 0.1 to 10, preferably between about 1 and 5, and liquid hourly space velocities (LHSV) range from about 1 to 8. In the preferred arrangement of this invention, the combined feed entering the hydrogenation zone will be heated to a temperature in the range of 90° to 120° C. by indirect heat exchange with the effluent or effluents from the selective-isoparaffin-synthesis zone. Lower temperatures are found to be most desirable for the hydrogenation reactions since nonselective cracking reactions thereby are minimized. Selective saturation of the aromatics results in a saturated intermediate from the hydrogenation zone usually containing less than 1 mass % aromatics. Although hydrogen and light hydrocarbons may be removed by flash separation and/or fractionation from the saturated intermediate between the hydrogenation zone and the selective-isoparaffin-synthesis zone, the intermediate preferably is transferred between zones without separation of hydrogen or light hydrocarbons. The exothermic saturation reaction provides a heated, saturated intermediate to the selective-isoparaffin-synthesis zone which generally requires no further heating to effect the required selective isoparaffin-synthesis temperature. A cooler or other heat exchanger between the hydrogenation zone and selective-isoparaffin-synthesis zone may be appropriate for temperature flexibility or for the startup of the process combination.

Alternative aromatics removal from the naphtha feedstock may be effected within the scope of the invention by solvent extraction or adsorptive separation. Solvent extraction for aromatics separation is well known in the art and may be accomplished using solvent compositions comprising one or more organic compounds containing at least one polar group such as a hydroxyl-, amino-, cyano-, carboxyl-, or nitro- group; preferably the solvent is selected from one or more of the aliphatic and cyclic alcohols, cyclic monomeric sulfones, glycols and glycol ethers, glycol esters and glycol ether esters. Adsorptive separation may be effected using a selective molecular sieve. This alternative aromatics-removal step features the advantage of reduced hydrogen consumption and produces an aromatics concentrate, but does not heat the intermediate sent to selective isoparaffin synthesis via an exothermic heat of reaction and reduces the yield of cracked products relative to the preferred hydrogenation step.

The saturated intermediate has an aromatics content which is reduced generally about 90% or more relative to the naphtha feedstock. Usually the aromatics content will be less than about 0.1 mass %, and often in the region of about 100 mass ppm or less although such low levels are not critical to the utility of the process combination.

The saturated intermediate is introduced into the selective-isoparaffin-synthesis zone containing an active, selective isoparaffin-synthesis catalyst operating at pressures and temperatures which are significantly below those employed in conventional hydrocracking. Heavier components of the naphtha are converted principally to isoparaffins in the presence of hydrogen with minimum formation of light hydrocarbon gases such as methane and ethane. Side chains are removed from heavier cyclic compounds while retaining most of the cyclic rings. Heavy paraffins are converted to yield a high proportion of isobutane, useful for production of alkylate or ethers for gasoline blending. The isobutane generally is at a "superequilibrium" level, i.e., the proportion of isobutane in total butanes is above the equilibrium level at synthesis-zone temperatures and thus is higher than could be achieved by isomerization of butanes. Pentanes formed in the conversion reaction comprise a high proportion, greater than generally would be obtained by isomerization, of isopentane, and other synthesized paraffins also have a preponderance of branched-chain isomers. The overall effect is that the molecular weight and final boiling point of the hydrocarbons are reduced, naphthenic rings are substantially retained, and the content of isoparaffins is increased significantly in the synthesis product relative to the naphtha feedstock.

The content of isobutane in total butanes, and usually the content of isopentane in total pentanes, is greater than the equilibrium values derived from, e.g., Stull, Daniel L., et al., *The Chemical Thermodynamics of Organic Compounds,* John Wiley and Sons (1969), esp. pp 245–246 for the relevant operating temperature. This product ratio is designated herein as superequilibrium isobutane or isopentane, respectively. Therefore, the present process generally yields a higher proportion of these isomers than would be achievable by isomerization of the corresponding paraffin fraction.

Selective isoparaffin-synthesis operating conditions vary according to the characteristics of the feedstock and the product objectives. Operating pressure range between about 10 atmospheres and 100 atmospheres gauge, and preferably between about 15 and 40 atmospheres. Temperature is selected to balance conversion, which is promoted by higher temperatures, against favorable isomerization equilibrium and product selectivity which are favored by lower temperatures; operating temperature generally is between about 50° and 350° C., preferably between 80° C. and 205° C. and especially about 180° C. or more. The quantity of catalyst is sufficient to provide a liquid hourly space velocity of between about 0.5 and 20 $hr^{-1}$, and more usually between about 1.0 and 10 $hr^{-1}$. The operating conditions generally will be sufficient to effect a yield of at least 8 volume % butanes, and preferably about 15 volume % or more, from the selective-isoparaffin-synthesis zone relative to the quantity of saturated intermediate feed to the zone.

Hydrogen is supplied to the reactors of the selective isoparaffin-synthesis process not only to provide for hydrogen consumed in cracking, saturation and other reactions but also to maintain catalyst stability. The hydrogen may be partially or totally supplied from outside the process, but preferably a substantial proportion of the requirement is provided by hydrogen recycled after separation from the reactor effluent. The molar ratio of hydrogen to saturated-intermediate feedstock ranges usually from about 1.0 to 10, but may be as low as 0.05 in reactor effluent to obviate hydrogen recycle.

The selective-isoparaffin-synthesis zone contains a solid acid selective isoparaffin-synthesis catalyst. The acid component may comprise, for example, a halide, such as aluminum chloride, and/or a zeolite, such as mordenite. The selective isoparaffin-synthesis catalyst is effective in producing a superequilibrium concentration of isobutane in butanes produced in the selective-isoparaffin-synthesis zone at selective-isoparaffin-synthesis conditions.

The selective isoparaffin-synthesis catalyst preferably comprises an inorganic-oxide binder, a Friedel-Crafts metal halide and a Group VIII (8–10) metal component. The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the present invention is alumina. Suitable alumina materials are the crystalline aluminas known as the gamma-, eta-, and theta-alumina, with gamma- or eta-alumina giving best results. Zirconia, alone or in combination with alumina, comprises an alternative inorganic-oxide component of the catalyst. The preferred refractory inorganic oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$.

A particularly preferred alumina is that which has been characterized in U.S. Pat. Nos. 3,852,190 and 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into a suitable catalyst material according to any of the techniques known to those skilled in the catalyst-carrier-forming art. Spherical carrier particles may be formed, for example, from this Ziegler alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter rolling the extrudate particles on a spinning disk until spherical particles are formed which can then be dried and calcined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the selective isoparaffin-synthesis catalyst is a cylindrical extrudate. The extrudate particle is optimally prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the preferred selective isoparaffin-synthesis catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass % of the final catalyst calculated on an elemental basis. Excellent results are obtained when the catalyst contains from about 0.05 to 1 mass % of platinum.

The platinum-group metal component may be incorporated into the selective isoparaffin-synthesis catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The composite, before addition of the Friedel-Crafts metal halide, is dried and calcined. The drying is carried out at a temperature of about 100° to 300°, followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

Suitable metal halides comprising the Friedel-Crafts metal component of the selective isoparaffin-synthesis catalyst include aluminum chloride, aluminum bromide, ferric chloride, ferric bromide, zinc chloride and the like compounds, with the aluminum halides and particularly aluminum chloride ordinarily yielding best results. Generally, this component can be incorporated into the catalyst of the present invention by way of the conventional methods for adding metallic halides of this type; however, best results are ordinarily obtained when the metallic halide is sublimed onto the surface of the support according to the preferred method disclosed in U.S. Pat. No. 2,999,074, which is incorporated herein by reference.

As aluminum chloride sublimes at about 184° C., suitable impregnation temperatures range from about 190° C. to 750° C. with a preferable range being from about 500° C. to 650° C. The sublimation can be conducted at atmospheric pressure or under increased pressure and in the presence of absence of diluent gases such a hydrogen or light paraffinic hydrocarbons or both. The impregnation of the Friedel-Crafts metal halide may be conducted batch-wise, but a preferred method for impregnating the calcined support is to pass sublimed $AlCl_3$ vapors, in admixture with a carrier gas such as hydrogen, through a calcined catalyst bed. This method both continuously deposits and reacts the aluminum chloride and also removes the hydrogen chloride evolved during the reaction.

The amount of Friedel-Crafts metal halide combined with the calcined support may range from about 1 up to 15 mass % relative to the calcined composite prior to introduction of the metal-halide component. The composite containing the sublimed Friedel-Crafts metal halide is treated to remove the unreacted Friedel-Crafts metal halide by subjecting the composite to a temperature above the sublimation temperature of the Friedel-Crafts metal halide, preferably below about 750° C., for a time sufficient to remove any unreacted metal halide. In the case of $AlCl_3$, temperatures of about 500° C. to 650° C. and times of from about 1 to 48 hours are preferred.

An optional component of the preferred catalyst is an organic polyhalo component. In this embodiment, the composite is further treated preferably after introduction of the Friedel-Crafts metal halide in contact with a polyhalo compound containing at least 2 chlorine atoms and selected from the group consisting of methylene halide, haloform, methylhaloform, carbon tetrahalide, sulfur dihalide, sulfur halide, thionyl halide, and thiocarbonyl tetrahalide. Suitable polyhalo compounds thus include methylene chloride, chloroform, methylchloroform, carbon tetrachloride, and the like. In any case, the polyhalo compound must contain at least two chlorine atoms attached to the same carbon atom. Carbon tetrachloride is the preferred polyhalo compound. The composite contacts the polyhalo compound preferably diluted in a non-reducing gas such as nitrogen, air, oxygen and the like. The contacting suitably is effected at a temperature of from about 100° to 600° C. over a period of from about 0.2 to 5 hours to add at least 0.1 mass % combined halogen to the composite.

The catalyst of the present invention may contain an additional halogen component. The halogen component may be either fluorine, chlorine, bromine or iodine or mixtures thereof with chlorine being preferred. The halogen component is generally present in a combined state with the inorganic-oxide support. The halogen component may be incorporated in the catalyst in any suitable manner, either during the preparation of the inorganic-oxide support or before, while or after other catalytic components are incorporated. For example, chloroplatinic acid may be used in impregnating a platinum component. The halogen component is preferably well dispersed throughout the catalyst and may comprise from more than 0.2 to about 15 mass %, calculated on an elemental basis, of the final catalyst.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. If sulfur is present in the feed, activity of the catalyst may be restored by hot hydrogen stripping of sulfur from the catalyst composition or by lowering the sulfur concentration in the incoming feed to below 0.5 ppm. The feed may be treated by any method that will remove water and sulfur compounds. Sulfur may be removed from the feed stream by hydrotreating. Adsorption systems for the removal of sulfur and water from hydrocarbon streams are well known to those skilled in the art.

The chlorided platinum-alumina catalyst described hereinabove also requires the presence of a small amount of an organic chloride promoter in the selective-isoparaffin-synthesis zone. The organic chloride promoter serves to maintain a high level of active chloride on the catalyst, as low levels are continuously stripped off the catalyst by the hydrocarbon feed. The concentration of promoter in the combined feed is maintained at from 30 to 300 mass ppm. The preferred promoter compound is carbon tetrachloride. Other suitable promoter compounds include oxygen-free decomposable organic chlorides such as propyldichloride, butylchloride, and chloroform, to name only a few of such compounds. The need to keep the reactants dry is reinforced by the presence of the organic chloride compound which may convert, in part, to hydrogen chloride. As long as the hydrocarbon feed and hydrogen are dried as described hereinabove, there will be no adverse effect from the presence of small amounts of hydrogen chloride.

Contacting within the selective-isoparaffin-synthesis zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. In this system, a hydrogen-rich gas and the charge stock are preheated by suitable heating means to the desired reaction temperature and then passed into a selective-isoparaffin-synthesis zone containing a fixed bed of the catalyst particle as previously characterized. The selective-isoparaffin-synthesis zone may be in a single reactor or in two or more separate reactors with suitable means therebetween to insure that the desired selective isoparaffin-synthesis temperature is maintained at the entrance to each reactor. Two or more reactors in sequence are preferred to control individual reactor temperatures in light of the exothermic heat of reaction and for partial catalyst replacement without a process shutdown. The reactants may be contacted with the bed of catalyst particles in either upward, downward, or radial flow fashion. The reactants may be in the liquid phase, a mixed liquid-vapor phase, or a vapor phase when contacted with the catalyst particles.

The selective-isoparaffin-synthesis zone generally comprises a separation section, optimally comprising one or more fractional distillation columns having associated appurtenances and separating an isobutane-rich stream, a light synthesis product and a heavy synthesis product from total synthesis product obtained from the reaction.

The isobutane-rich stream has a concentration of between about 70 and 95 mole % isobutane in total butanes and more usually in excess of 80 mole % isobutane. Optionally, an isopentane-rich stream also may be recovered from the synthesis product either in admixture with the isobutane or as a separate stream. The isopentane produced in the selective-isoparaffin-synthesis zone otherwise is recovered in a light synthesis product fraction which usually is sent to gasoline blending. The isobutane-rich stream may be further upgraded via dehydrogenation and etherification or alkylation, as described hereinafter.

The light synthesis product fraction normally comprises pentanes and hexanes in admixture, and also may contain smaller concentrations of naphthenes and $C_7$ hydrocarbons; benzene usually is substantially absent. Usually over 80 mole %, and optimally over 90 mole %, of the $C_6$ hydrocarbons in the synthesis product are contained in the light synthesis product; $C_6$ hydrocarbons directed to the heavy synthesis product and subsequently reformed would be partially converted to benzene, which is undesirable in gasoline for environmental reasons.

In one embodiment, part or all of the isobutane-rich stream is sent to a dehydrogenation zone. In the dehydrogenation zone, isobutane is converted selectively to isobutene as feed to etherification and/or alkylation. Optionally, part or all of the isopentane also is dehydrogenated to yield isopentene as additional etherification feed.

A suitable dehydrogenation reaction zone for this invention preferably comprises one or more radial-flow reactors through which the catalyst gravitates downward with continuous removal of spent catalyst, as described in U.S. Pat. No. 3,978,150 which is incorporated herein by reference. Preferably, the dehydrogenation reactor section comprises multiple stacked or side-by-side reactors, and a combined stream of hydrogen and hydrocarbons is processed serially through the multiple reactors each of which contains a particulate catalyst disposed as an annular-form moving bed. The moving catalyst bed permits continuous addition of fresh and/or regenerated catalyst and the withdrawal of spent catalyst, and is illustrated in U.S. Pat. No. 3,647,680 which is incorporated by reference. Since the dehydrogenation reaction is endothermic in nature, intermediate heating of the reactant stream between reactors is the optimal practice.

Dehydrogenation conditions generally include a pressure of from about 0 to 35 atmospheres, more usually no more than about 5 atmospheres. Suitable temperatures range from about 480° C. to 760° C., optimally from about 540° C. to 705° C. when processing a light liquid comprising isobutane and/or isopentane. Hydrogen is admixed with the hydrocarbon feedstock in a mole ratio of from about 0.1 to 10, and more usually from about 0.5 to 2. Catalyst is available in dehydrogenation reactors to provide a liquid hourly space velocity of from about 1 to 10, and preferably no more than about 5.

The dehydrogenation catalyst comprises a platinum-group metal component, preferably a platinum component, and an alkali-metal component on a refractory support. The alkali-metal component is chosen from cesium, rubidium, potassium, sodium, and lithium. The catalyst also may contain promoter metals, preferably tin in an atomic ratio of tin to platinum be between 1:1 and about 6:1. The refractory support of the dehydrogenation catalyst should be a porous, absorptive high-surface-area material as delimited hereinabove for the reforming catalyst. A refractory inorganic oxide is the preferred support, with alumina being particularly preferred.

The dehydrogenation zone will produce a near-equilibrium mixture of the desired isoolefin and its isoalkane precursor. Preferably an isobutane-rich stream is processed to yield an isobutene-containing stream. Alternatively or additionally, an isopentene-containing stream is produced from and isopentane-rich stream. A separation section recovers hydrogen from the product for use elsewhere.

Optionally part or all of an olefin-containing product stream from the dehydrogenation zone is used to produce one or more ethers in an etherification zone. The olefin-containing stream preferably contains isobutene which yields alkyl t-butyl ethers, and may comprise isopentene which yields alkyl t-amyl ethers. In addition, one or more monohydroxy alcohols are fed to the etherification zone. Ethanol is a preferred monohydroxy-alcohol feed, and methanol is especially preferred. This variety of possible feed materials allows the production of a variety of ethers in addition to or instead of the preferred methyl tertiary-butyl ether (MTBE). These useful ethers include ethyl tertiary butyl ether (ETBE), methyl tertiary amyl ether (MTAE) and ethyl tertiary amyl ether (ETAE).

Processes operating with vapor, liquid or mixed-phase conditions may be suitably employed in this invention. The preferred etherification process uses liquid-phase etherification conditions, including a superatmospheric pressure sufficient to maintain the reactants in liquid phase but no more than about 50 atmospheres; even in the presence of additional light materials, pressures in the range of 10 to 40 atmospheres generally are sufficient to maintain liquid-phase conditions. Operating temperature is between about 30° C. and 100° C.; the reaction rate is normally faster at higher temperatures, but conversion is more complete at lower temperatures. High conversion in a moderate volume reaction zone can, therefore, be obtained if the initial section of the reaction zone, e.g., the first two-thirds, is maintained above 70° C. and the remainder of the reaction zone is maintained below 50° C. This may be accomplished most easily with two reactors.

The ratio of feed alcohol to isoolefin should normally be maintained in the broad range of 1:1 to 2:1. With the preferred reactants, good results are achieved if the ratio of methanol to isobutene is between 1.05:1 and 1.5:1. An excess of methanol, above that required to achieve satisfactory conversion at good selectivity, should be avoided as some decomposition of methanol to dimethylether may occur with a concomitant increase in the load on separation facilities.

A wide range of materials are known to be effective as etherification catalysts including mineral acids such as sulfuric acid, boron trifluoride, phosphoric acid on kieselguhr, phosphorus-modified zeolites, heteropoly acids, and various sulfonated resins. The use of a sulfonated solid resin catalyst is preferred. These resin type catalysts include the reaction products of phenolformaldehyde resins and sulfuric acid and sulfonated polystyrene resins including those cross-linked with divinylbenzene. Further information on suitable etherification catalysts may be obtained by reference to U.S. Pat. Nos. 2,480,940, 2,922,822, and 4,270,929 and the previously cited etherification references.

In the preferred etherification process for the production of MTBE, essentially all of the isobutene is converted to MTBE thereby eliminating the need for subsequently separating that olefin from isobutane. As a result, downstream separation facilities are simplified. Several suitable etherification processes have been described in the literature which presently are being used to produce MTBE. The preferred form of the etherification zone is similar to that described in U.S. Pat. No. 4,219,678. In this instance, the isobutene, methanol and a recycle stream containing recovered excess alcohol are passed into the etherification zone and contacted at etherification conditions with an acidic etherification catalyst to produce an effluent containing MTBE.

The effluent from the etherification-zone reactor section includes at least product ethers, light hydrocarbons, dehydrogenatable hydrocarbons, and any excess alcohol. The effluent may also include small amounts of hydrogen and of other oxygen-containing compounds such as dimethyl ether and TBA. The effluent passes from the etherification reactor section to a separation section for the recovery of product. The etherification effluent is separated to recover the ether product, preferably by fractional distillation with ether being taken as bottoms product; this product generally is suitable for gasoline blending but may be purified further, e.g., by azeotropic distillation.

The overhead from ether separation containing unreacted hydrocarbons is passed through a methanol recovery zone for the recovery of methanol, preferably by adsorption, with return of the methanol to the etherification reactor section. The hydrocarbon-rich stream is fractionated to remove $C_3$ and lighter hydrocarbons and oxygenates from the stream of unreacted $C_4$–$C_5$ hydrocarbons. Heavier oxygenate compounds are removed by passing the stream of unreacted hydrocarbons through a separate oxygenate recovery unit. This hydrocarbon raffinate, after oxygenate removal, may be dehydrogenated to provide additional feedstock for the etherification zone or used as part of the feed to an alkylation reaction zone to produce high octane alkylate.

A portion of the isobutane-rich stream from the separation section and a portion of the iso-olefin-containing stream from the dehydrogenation zone may be processed in an alkylation zone. The alkylation zone optionally may process other isobutane- or olefin-containing streams from an associated petroleum refinery.

The optional alkylation zone of this invention may be any acidic catalyst reaction system such as a hydrogen fluoride-catalyzed system, sulfuric-acid system or one which utilizes an acidic catalyst in a fixed-bed reaction system. Hydrogen fluoride alkylation is particularly preferred, and may be conducted substantially as set forth in U.S. Pat. No. 3,249,650. The alkylation reaction in the presence of hydrogen fluoride catalyst is conducted at a catalyst to hydrocarbon volume ration within the alkylation reaction zone of from about 0.2 to 2.5 and preferably about 0.5 to 1.5. Ordinarily, anhydrous hydrogen fluoride will be charged to the alkylation system as fresh catalyst; however, it is possible to utilize hydrogen fluoride containing as much as 10.0% water or more. Excessive dilution with water is generally to be avoided since it tends to reduce the alkylating activity of the catalyst and further introduces corrosion problems. In order to reduce the tendency of the olefinic portion of the charge stock to undergo polymerization prior to alkylation, the molar proportion of isoparaffins to olefinic hydrocarbons in an alkylation reactor is desirably maintained at a value greater than 1.0, and preferably from about 3.0 to 15.0. Alkylation reaction conditions, as catalyzed by hydrogen fluoride, include a temperature of from −20° to about 100° C., and preferably from about 0° to 50° C. The pressure maintained within the alkylation system is ordinarily at a level sufficient to maintain the hydrocarbons and catalyst in a substantially liquid phase; that is, from about atmospheric to 40 atmospheres. The contact time within the alkylation reaction zone is conveniently expressed in terms of space-time, being defined as the volume of catalyst within the reactor contact zone divided by the volume rate per minute of hydrocarbon reactants charged to the zone. Usually the space-time will be less than 30 minutes and preferably less than about 15 minutes.

Alkylate recovered from the alkylation zone generally comprises n-butane and heavier components, with isobutane and lighter materials having been removed by fractionation and returned to the reactor. At least a portion, and preferably all, of the alkylate is blended into gasoline.

It is within the scope of the invention that a portion of the light synthesis product, especially the $C_6$ portion, is isomerized in an isomerization zone. Usually, the $C_5$ portion would not be upgraded by isomerization, since the pentanes already generally comprise an isopentane/n-pentane ratio in excess of equilibrium at usual isomerization conditions.

Contacting within the isomerization zone may be effected using the catalyst in a fixed-bed system, a moving-bed system, a fluidized-bed system, or in a batch-type operation. A fixed-bed system is preferred. The isomerization zone may be in a single reactor or in two or more separate reactors with suitable means therebetween to insure that the desired isomerization temperature is maintained at the entrance to each zone. Two or more reactors in sequence are preferred to enable improved isomerization through control of individual reactor temperatures and for partial catalyst replacement without a process shutdown. The reactants may be contacted with the bed of catalyst particles in either upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation.

Isomerization conditions in the isomerization zone include reactor temperatures usually ranging from about 40° to 250° C. Lower reaction temperatures are generally preferred in order to favor equilibrium mixtures having the highest concentration of high-octane highly branched isoalkanes and to minimize cracking of the feed to lighter hydrocarbons. Temperatures in the range of from about 40° to about 150° C. are preferred in the present invention. Reactor operating pressures generally range from about atmospheric to 100 atmospheres, with preferred pressures in the range of from 20 to 35 atmospheres. Liquid hourly space velocities range from about 0.25 to about 12 volumes of isomerizable hydrocarbon feed per hour per volume of catalyst, with a range of about 0.5 to 5 $hr^{-1}$ being preferred.

Hydrogen is admixed with the feed to the isomerization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mol ratio in the reactor effluent is equal to or less than 0.05, generally obviating the need to recycle hydrogen from the reactor effluent to the feed.

Any catalyst known in the art to be suitable for the isomerization of paraffin-rich hydrocarbon streams may be used as an isomerization catalyst in the isomerization zone. One suitable isomerization catalyst comprises a platinum-group metal, hydrogen-form crystalline aluminosilicate and a refractory inorganic oxide, and the composition preferably has a surface area of at least 580 $m^2/g$. The preferred noble metal is platinum which is present in an amount of from about 0.01 to 5 mass % of the composition, and optimally from about 0.15 to 0.5 mass %. Catalytically effective amounts of one or more promoter metals preferably selected from Groups VIB(6), VIII(8–10), IB(11), IIB(12), IVA(14), rhenium, iron, cobalt, nickel, gallium and indium also may be present. The crystalline aluminosilicate may be synthetic or naturally occurring, and preferably is selected from the group consisting of FAU, LTL, MAZ and MOR with mordenite having a silica-to-alumina ratio of from 16:1 to 60:1 being especially preferred. The crystalline aluminosilicate generally comprises from about 50 to 99.5 mass % of the composition, with the balance being the refractory inorganic oxide. Alumina, and preferably one or more of gamma-alumina and eta-alumina, is the preferred inorganic oxide. Further details of the composition are disclosed in U.S. Patent 4,735,929, incorporated herein by reference thereto.

A preferred isomerization catalyst composition comprises one or more platinum-group metals, a halogen, and an inorganic-oxide binder. Preferably the catalyst contains a Friedel-Crafts metal halide, with aluminum chloride being especially preferred. The optimal platinum-group metal is platinum which is present in an amount of from about 0.1 to 0.5 mass %. The composition may also contain an organic polyhalo component, with carbon tetrachloride being preferred, and the total chloride content is from about 2 to 10 mass %. The inorganic oxide preferably comprises alumina, with one or more of gamma-alumina and eta-alumina providing best results. Optimally, the carrier material is in the form of a calcined cylindrical extrudate. Other details and alternatives of preparation steps and operation of the preferred isomerization catalyst are as presented hereinabove for the selective isoparaffin-synthesis catalyst. Optionally, the same catalyst may be used in the selective isoparaffin-synthesis and isomerization zones. U.S. Pat. Nos. 2,999,074 and 3,031,419 teach additional aspects of this composition and are incorporated herein by reference.

Isomerate recovered from once-through processing of light naphtha does contain some low-octane normal paraffins and intermediate-octane methylhexanes as well as the desired highest-octane isopentane and dimethylbutane. It is within the scope of the present invention that the product from the reactors of the isomerization process is subjected to separation and recycle of the lower-octane portion to the isomerization reaction. Low-octane normal paraffins are separated and recycled in this embodiment to obtain an iso-rich product, and less-branched hexanes also may be separated and recycled. Techniques to achieve this separation are well known in the art, and include fractionation and molecular-sieve adsorption.

Heavy synthesis product optionally may be processed in a reforming zone to obtain a reformate product of increased octane number. Reforming may be carried out in two or more fixed-bed reactors in sequence or in moving-bed reactors with continuous catalyst regeneration. Reforming operating conditions include a pressure of from about atmospheric to 60 atmospheres (absolute), with the preferred range being from atmospheric to 20 atmospheres and a pressure of below 10 atmospheres being especially preferred. Hydrogen is supplied to the reforming zone in an amount sufficient to correspond to a ratio of from about 0.1 to 10 moles of hydrogen per mole of hydrocarbon feedstock. The operating temperature generally is in the range of 260° to 560° C. The volume of the contained reforming catalyst corresponds to a liquid hourly space velocity of from about 1 to 40 $hr^{-1}$.

The reforming catalyst conveniently is a dual-function composite containing a metallic hydrogenation-dehydrogenation component on a refractory support which provides acid sites for cracking, isomerization, and cyclization. The hydrogenation-dehydrogenation component comprises a supported platinum-group metal component, with a platinum component being preferred. The platinum may exist within the catalyst as a compound, in chemical combination with one or more other ingredients of the catalytic composite, or as an elemental metal; best results are obtained when substantially all of the platinum exists in the catalytic composite in a reduced state. The catalyst may contain other metal components known to modify the effect of the preferred platinum component, including Group IVA (14) metals, other Group VIII (8–10) metals, rhenium, indium, gallium, zinc, uranium, dysprosium, thallium and mixtures thereof with a tin component being preferred.

The refractory support of the reforming catalyst should be a porous, adsorptive, high-surface-area material which is uniform in composition. Preferably the support comprises refractory inorganic oxides such as alumina, silica, titania, magnesia, zirconia, chromia, thoria, boria or mixtures thereof, especially alumina with gamma- or eta-alumina being particularly preferred and best results being obtained with "Ziegler alumina" as described in the references. Optional ingredients are crystalline zeolitic aluminosilicates, either naturally occurring or synthetically prepared such as FAU, MEL, MFI, MOR, MTW (IUPAC Commission on Zeolite Nomenclature), and non-zeolitic molecular sieves such as the aluminophosphates of U.S. Pat. No. 4,310,440 or the silico-aluminophosphates of U.S. Pat. No. 4,440,871 (incorporated by reference). Further details of the preparation and activation of embodiments of the above reforming catalyst are disclosed in U.S. Pat. No. 4,677,094 (Moser et al.), which is incorporated into this specification by reference thereto.

In an advantageous alternative embodiment, the reforming catalyst comprises a large-pore molecular sieve. The term "large-pore molecular sieve" is defined as a molecular sieve having an effective pore diameter of about 7 angstroms or larger. Examples of large-pore molecular sieves which might be incorporated into the present catalyst include LTL, FAU, AFI, MAZ, and zeolite-beta, with a nonacidic L-zeolite (LTL) being especially preferred. An alkali-metal component, preferably comprising potassium, and a platinum-group metal component, preferably comprising platinum, are essential constituents of the alternative reforming catalyst. The alkali metal optimally will occupy essentially all of the cationic exchangeable sites of the nonacidic L-zeolite. Further details of the preparation and activation of embodiments of the alternative reforming catalyst are disclosed, e.g., in U.S. Pat. Nos. 4,619,906 (Lambert et al) and 4,822,762 (Ellig et al.), which are incorporated into this specification by reference thereto.

Preferably part or all of each of the synthesis product and optional light synthesis product, ether, alkylate, isomerized product and reformate are blended to produce a gasoline component. Finished gasoline may be produced by blending the gasoline component with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention. The feedstock used in all examples is a full-range naphtha derived from a paraffinic mid-continent crude oil and has the following characteristics:

| | |
|---|---|
| Specific gravity | 0.746 |
| Distillation, ASTM D-86, °C. | |
| IBP | 86 |
| 50% | 134 |
| EP | 194 |
| Mass % | |
| paraffins | 63.7 |
| naphthenes | 24.0 |
| aromatics | 12.3 |
| Mass % | |
| $C_5$ | 0.2 |
| $C_6$ | 12.1 |
| $C_7$ | 19.3 |
| $C_8$ | 20.2 |
| $C_9$+ | 48.2 |

Example 1

The benefits of using the process combination of the invention are illustrated by contrasting results with those from a corresponding process of the prior art. Example 1 presents results based on the use of a prior-art process combination.

The prior art is illustrated by selective isoparaffin synthesis from the naphtha feedstock described above without prior hydrogenation of the aromatics in the feedstock. A pilot plant was loaded with (i) quartz chips and (ii) a platinum-$AlCl_3$-on-alumina selective isoparaffin-synthesis catalyst as described hereinabove in a volumetric ratio of (i):(ii) of 4:5. The quartz chips served for effective control of the temperature of the feed to the selective-isoparaffin-synthesis zone. The selective isoparaffin-synthesis catalyst contained about 0.25 mass % platinum and 5.5 mass % chloride.

Selective isoparaffin synthesis from the naphtha feedstock was effected at a pressure of about 30 atmospheres and a hydrogen-to-hydrocarbon mol ratio of 2.5. Tests were carried out at inlet temperatures of 120°, 150° and 180° C. A temperature profile was constructed by measuring temperatures at 20 points across the catalyst bed. The profile is shown in FIG. 1.

In order to assess the impact of the invention on isoparaffin selectivity, ratios of isobutane/total butanes and isopentane/total pentanes were measured for the prior-art operation. These isoparaffin/total-paraffin ratios are shown, along with feed conversion to pentanes and lighter products, in FIG. 2.

Example 2

Results from applying the process combination of the inventions are illustrated in Example 2. Selective isoparaffin synthesis from the naphtha feedstock described above was effected following hydrogenation of the aromatics in the feedstock. A pilot plant was loaded with (a) a chlorided platinum-alumina catalyst, (b) quartz chips and (c) a platinum-$AlCl_3$-on-alumina selective isoparaffin-synthesis catalyst as described hereinabove in a volumetric ratio of (a):(b):(c) of 5:7:15. As in Example 1, the selective isoparaffin-synthesis catalyst contained about 0.25 mass % platinum and 5.5 mass % chloride.

The combination of aromatics saturation and selective isoparaffin synthesis from the naphtha feedstock was effected at a pressure of about 30 atmospheres and a hydrogen-to-hydrocarbon tool ratio of 2.5. Tests were carried out at inlet temperatures of 120°, 150° and 180° C. A temperature profile was constructed by measuring temperatures at 20 points across the catalyst bed. The profile is contrasted with that of the prior art in FIG. 1. Note that peak temperature across the selective isoparaffin-synthesis bed is less than 10° C. above inlet temperature, in contrast to the prior art for which the temperature increase is in the range of about 25° to 40° C.

Figure 2:
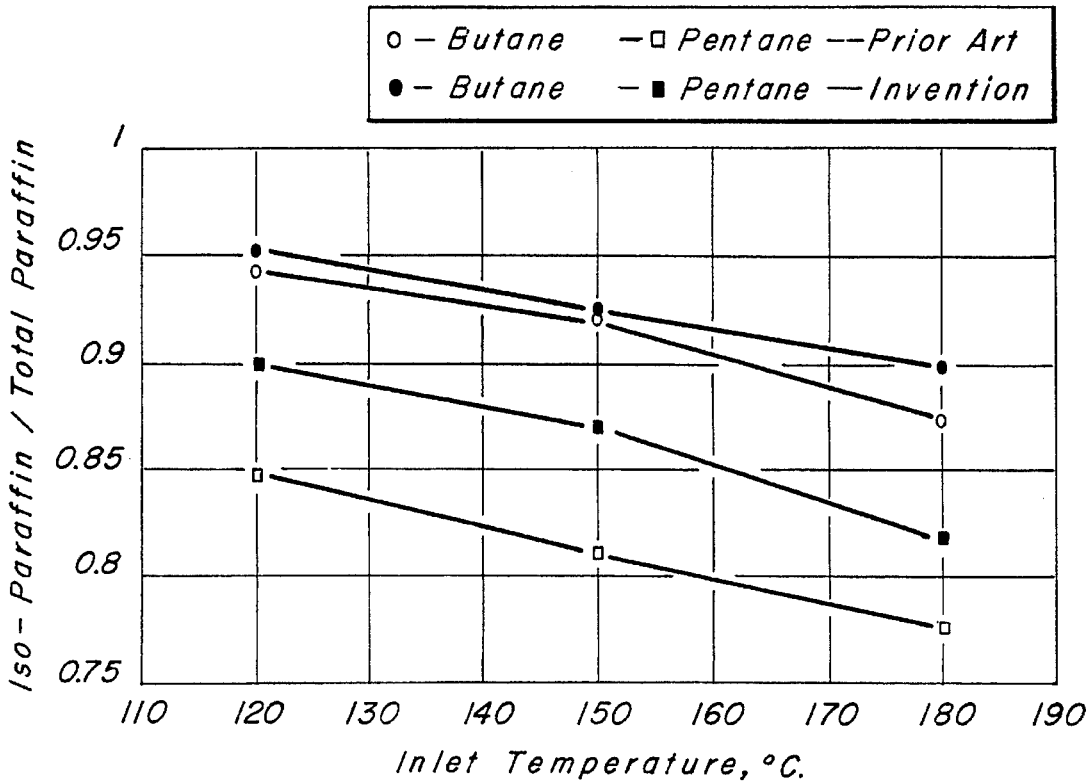
FIG. 2 compares product butane and pentane isomer ratios for processes of the invention and prior art corresponding to the cases of FIG. 1.
Figure 3:
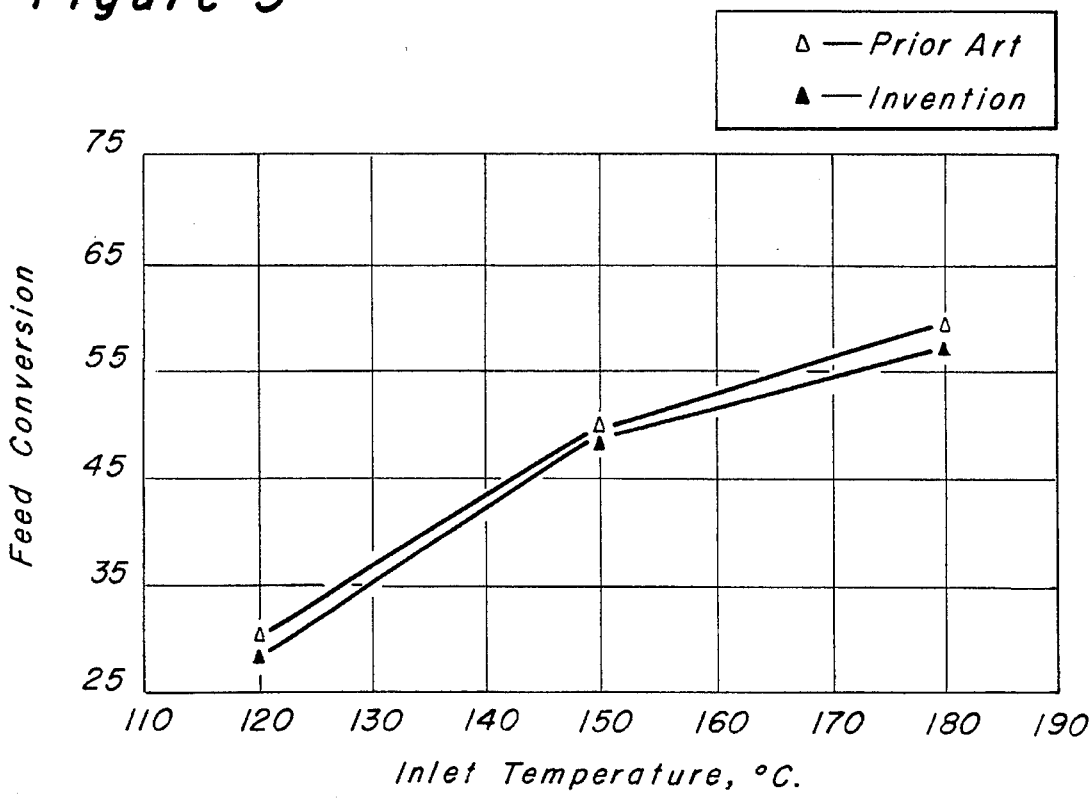
FIG. 3 compares feed conversions for processes of the invention and prior art.

In order to assess the impact of the invention on isoparaffin selectivity, product ratios of isobutane/total butanes and isopentane/total pentanes were measured for the processes of the invention and of the prior art. These isoparaffin/total-paraffin ratios are shown in FIG. 2. Note that the isobutane/butane ratios of the invention are somewhat higher than those of the prior art and the isopentane/pentane ratios are substantially higher when using the process combination of the invention. Considering equilibrium values of isobutane/total butanes as derived from Stull et al., supra, the proportion of isobutane is 0.26 to 0.28 higher than equilibrium and therefore the butane product contains superequilibrium isobutane.

The process combination of the invention is surprisingly effective in increasing the yield of isoparaffins from a selective isoparaffin-synthesis process, thus providing higher product octanes and more potential for valuable isoparaffin derivatives such as ethers and alkylate.

We claim as our invention:

1. A process combination for selectively upgrading a naphtha feedstock distilling within the range of about 80° to 200° C. to obtain lower-boiling hydrocarbons comprising the steps of:

(a) contacting the naphtha feedstock in a hydrogenation zone with a hydrogenation catalyst in the presence of hydrogen at hydrogenation conditions including a pressure of about 10 to 100 atmospheres, a temperature of 30° to 120° C. and a liquid hourly space velocity of from about 1 to 8 to produce a saturated intermediate; and, (b) converting the saturated intermediate in a selective-isoparaffin-synthesis zone maintained at selective-isoparaffin-synthesis conditions including a pressure of from about 10 to 100 atmospheres, a synthesis temperature of between about 50° and 350° C. and a liquid hourly space velocity of between about 0.5 and 20 with a solid acid selective isoparaffin-synthesis catalyst in the presence of hydrogen to yield at least 8 volume % relative to the quantity of saturated intermediate of butanes containing isobutane in a higher proportion than could be obtained by isomerization at the synthesis temperature and pentanes containing isopentane in a higher proportion than could be obtained by isomerization at the synthesis temperature and to obtain a synthesis product having a reduced end point relative to the naphtha feedstock.

2. The process combination of claim 1 wherein the naphtha feedstock contains less than about 5 mass % $C_6$ and lighter paraffins.

3. The process combination of claim 1 wherein the naphtha feedstock contains only a minor amount of $C_6$ and lighter paraffins resulting from fractionation imprecision.

4. The process combination of claim 1 wherein the saturated intermediate is transferred from the hydrogenation zone to the selective-isoparaffin-synthesis zone without separation of hydrogen or light hydrocarbons.

5. The process combination of claim 3 wherein the saturated intermediate is transferred from the hydrogenation zone to the selective-isoparaffin-synthesis zone without heating.

6. The process combination of claim 1 wherein the hydrogenation catalyst comprises a supported platinum-group metal component.

7. The process combination of claim 6 wherein the platinum-group metal component comprises a platinum component.

8. The process combination of claim 6 wherein the hydrogenation-catalyst support comprises a refractory inorganic oxide.

9. The process combination of claim 6 wherein the hydrogenation catalyst further comprises one or more metals of Group VIB (6), Group VIII (8–10) and Group IVA (14).

10. The process combination of claim 1 wherein the selective isoparaffin-synthesis catalyst comprises a platinum-group metal component on a chlorided inorganic-oxide support.

11. The process combination of claim 10 wherein the platinum-group metal component comprises a platinum component.

12. The process combination of claim 10 wherein the inorganic-oxide support comprises alumina.

13. The process combination of claim 10 wherein the catalyst comprises a Friedel-Crafts metal halide.

14. The process combination of claim 13 wherein the Friedel-Crafts metal halide comprises aluminum chloride.

15. A process combination for selectively upgrading a naphtha feedstock distilling within the range of about 80° to 200° C. to obtain lower-boiling hydrocarbons comprising the steps of:

(a) contacting the naphtha feedstock in a hydrogenation zone with a hydrogenation catalyst in the presence of hydrogen at hydrogenation conditions including a pressure of about 10 to 100 atmospheres, a temperature of 30° to 120° C. and a liquid hourly space velocity of from about 1 to 8 to produce a saturated intermediate; and, (b) converting the saturated intermediate without heating in a selective-isoparaffin-synthesis zone maintained at selective-isoparaffin-synthesis conditions including a pressure of from about 10 to 100 atmospheres, a synthesis temperature of between about 50° and 350° C. and a liquid hourly space velocity of between about 0.5 and 20 with a solid acid selective isoparaffin-synthesis catalyst in the presence of hydrogen to yield at least 8 volume % relative to the quantity of saturated intermediate of butanes containing isobutane in a higher proportion than could be obtained by isomerization at the synthesis temperature and pentanes containing isopentane in a higher proportion than could be obtained by isomerization at the synthesis temperature and to obtain a synthesis product having a reduced end point relative to the naphtha feedstock.

* * * * *